United States Patent [19]

Ahern et al.

[11] Patent Number: 4,916,356

[45] Date of Patent: Apr. 10, 1990

[54] HIGH EMISSIVITY COLD CATHODE ULTRASTRUCTURE

[75] Inventors: Brian S. Ahern, Boxboro; David W. Weyburne, Maynard, both of Mass.

[73] Assignee: The United States of America as represented by the Secretary of the Air Force, Washington, D.C.

[21] Appl. No.: 249,628

[22] Filed: Sep. 26, 1988

[51] Int. Cl.[4] ..... H01J 1/30

[52] U.S. Cl. ..... 313/336; 313/346 R; 313/353

[58] Field of Search ..... 313/336, 309, 351, 353, 313/346 R

[56] References Cited

U.S. PATENT DOCUMENTS

| | | | |
|---|---|---|---|
| 1,479,693 | 1/1924 | Bennett | 313/336 X |
| 2,937,304 | 5/1960 | Goldberg et al. | 313/336 X |
| 3,303,372 | 2/1967 | Gager | 313/336 X |
| 3,631,291 | 12/1971 | Favreau | 313/345 |
| 3,913,520 | 10/1975 | Berg et al. | 313/309 X |
| 3,991,385 | 11/1976 | Fein et al. | 331/94.5 D |
| 4,303,865 | 12/1981 | Swingler | 250/423 R |
| 4,468,586 | 8/1984 | Hohn | 313/336 |
| 4,551,649 | 11/1985 | Olson | 313/336 |

*Primary Examiner*—Palmer C. DeMeo

*Attorney, Agent, or Firm*—Stanton E. Collier; Donald J. Singer

[57] ABSTRACT

A high emissivity cold cathode has alternating cylindrical tube layers, deposited by vapor deposition, of a refractory metal such as niobium and a refractory insulating material such as alumina. The metal layers have a thickness of less than or about 1,000 angstroms such that the electric field strength at the exposed end is sufficient, in combination with a low work function metal to emit electrons when a voltage of about 2,000 volts is applied.

8 Claims, 1 Drawing Sheet

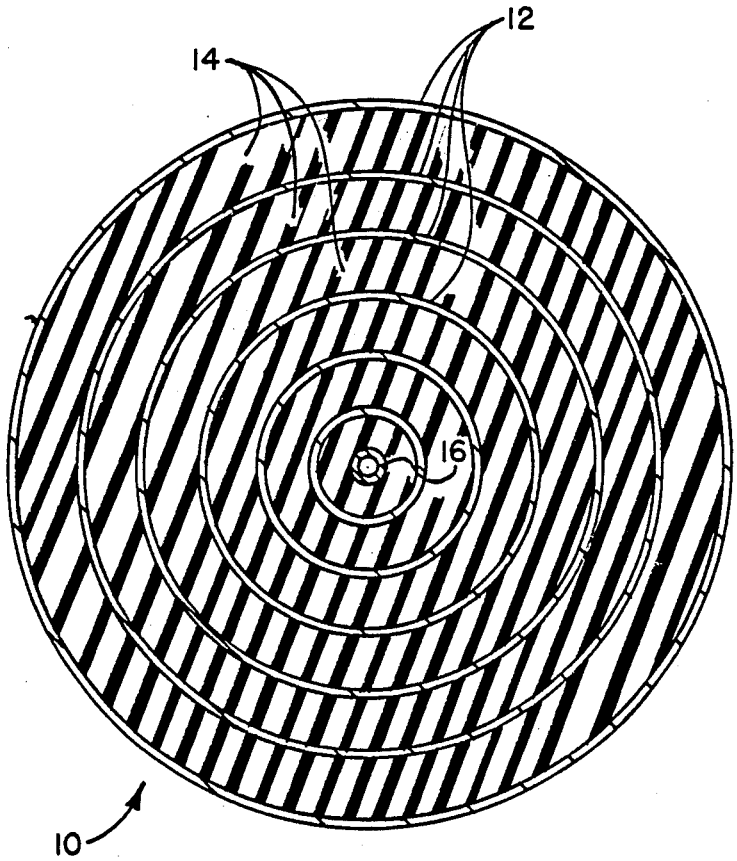
12
14
16
10

HIGH EMISSIVITY COLD CATHODE ULTRASTRUCTURE

STATEMENT OF GOVERNMENT INTEREST

The invention described herein may be manufactured and used by or for the Government for governmental purposes without the payment of any royalty thereon.

BACKGROUND OF THE INVENTION

The present invention relates to a device for outputting an electron plasma, and, in particular, a cold cathode operable at a significantly lower voltage and field strength.

The emission of electrons from the surface of a conductor into a vacuum or into an insulator under the influence of a strong electric filed has found many useful applications. One such application includes field emission microscopy in which some of the most powerful microscopes known have been constructed. Such microscopes generally utilize a "hairpin" cathode with a fine tungsten point at the apex of the hairpin as a source of electrons. Since the degree of magnification obtained by field emission microscopes is a function of the emission levels from the tungsten tip, it is desirable to utilize a hairpin filament with high emission levels so that high magnification can be obtained. Conditions conducive to high emission are a high operating temperature, an ultrahigh vacuum, and a high electric field. With these conditions, a relatively high emission can be obtained; however, the useful life of a hairpin filament operated in this manner is considerably reduced. Additionally, as a result of the high temperatures, the field emission microscope is limited in application to an investigation of those metals having a melting point higher than the operating temperature of the filament. Another application is the field of high power vacuum tube technology.

The conventional material used as a thermionic electron emission cathode for producing a shaped beam is tungsten. Lanthanum hexaboride ($LaB_6$) has been used to produce an unshaped or round beam in the past because it has a lower work function, higher melting temperature, and a lower vapor pressure than tungsten. Thus, $LaB_6$ cathodes have promised higher brightness at the same operating temperature and pressure, and longer life.

$LaB_6$ has not been used to produce a shaped beam because the beams produced by $LaB_6$ cathodes heretofore have always been characterized by a rather narrow angular distribution which is gaussian in shape. As a result, when such a beam is shaped with an aperture, the resulting beam does not have a uniform intensity distribution unless it is so small in size that it is impractical for use in microelectronic fabrication tools.

A tungsten cathode, on the other hand produces a very broad angular distribution and can generate an electron beam with very high total current. Although the tungsten produced beam is also gaussian, the angular distribution is so wide and the total beam so intense that a small center region of the angular distribution can be selected by a shaped aperture and the resulting beam has a nearly uniform intensity distribution.

Advanced cold cathode emitters currently in use employ low work function metals and alloys. These are formed by a variety of bulk solidification techniques. Unfortunately, these processing techniques dramatically reduce the operating efficiency and lifetime of these structures.

Bulk solidification techniques, such a eutectic solidification of $LaB_6$, form material much closer to thermodynamic equilibrium. Hence the solid will exhibit properties that are a function of that chemical equilibrium condition.

Currently, very high power Klystron tubes have average lifetimes of less than 100 hours. The major failure mechanism can be attributed to overheating at high electron fluences.

The above operating conditions and material characteristic have created a need for an improved cold cathode.

SUMMARY OF THE INVENTION

The present invention sets forth a cold cathode having multiple layers of insulating material and refractory metal layers that overcomes many of the problems noted hereinabove.

The use of extremely sharp edges produces high electric fields which, in turn, reduce the need for high operating temperatures. The present invention is a cold cathode having multiple cylindrical layers of alumina, for example, and niobium metal, for example, wherein each metal layer is about 500 to 1,000 angstroms thick which results in an edge radius many times smaller at least than conventional needle type cold cathodes. Using ultrastructure technology, one can generate nanometer scale layering of refractory metals with refractory oxides, borides, nitrides and carbides. This fine layering of refractory metals between two thicker insulating layers provides confinement structures for electric fields. The edge of one of these multi-layer structures provides a plurality of emitters that have locally increased electric field intensities. Electrons will be emitted from all these knife edge surfaces with lower voltages and/or less heating than is required in other 'state of the art' cathode structures.

Therefore, one object of the present invention is to provide a cold cathode operable at a significantly lower voltage.

Another object of the present invention is to provide a cold cathode that operates at much lower temperature.

Another object of the present invention is to provide a cold cathode that has significantly higher electric fields because of cathode geometry.

Another object of the present invention is to provide a cold cathode that has a greatly increased lifetime.

Another object of the present invention is to provide a cold cathode that provides lower impedance for high frequency operation.

These and many other objects and advantages of the present invention will be readily apparent to one skilled in the pertinent art from the following detailed description of a preferred embodiment of the invention and the related drawings.

BRIEF DESCRIPTION OF THE DRAWINGS

The only FIGURE of the invention is a top view showing the invention.

DETAILED DESCRIPTION OF THE PREFERRED EMBODIMENT

Spontaneous emission of electrons from any given surface occurs when several conditions are met: (1) The applied voltage generates a local electric field intensity that exceeds the work function of the cathode material; (2) Applied voltages are enhanced by thermal vibrations. Since electron emission can be viewed as a statistical phenomena, higher temperatures promote an exponential increase in electron emission. Unfortunately, heating to very high temperatures (~2,000° C.) is required before a significant quantity of electrons are thermally emitted. Cathode geometries can be adjusted to increase the local electric field strength so that lower voltages and field strengths are required.

This invention describes a process for fabricating cathodes that will take advantage of low work function materials, optimal geometries and field confinement to provide unsurpassed electron emission characteristics.

Referring to the only FIGURE, a cold cathode ultrastructure 10 is shown in cross-section wherein the refractory metal cylinders 12 are surrounded by refractory insulating cylinders 14 of greater thickness. The layering is continued until a desired diameter of cathode 10 is obtained.

The process of the present invention produces a fundamentally different cathode as compared to previous cathodes because the cathode 10 is processed in an extremely non-equilibrium fashion.

The cylinders formed by the vapor deposition technique remain in their metastable states for extended periods because the neighboring layers of insulation are selected to act as diffusion barriers. Layers 14 will also limit electro-migration under enormous electric potentials.

In order to reduce the edge radius in cathode 10, each metal cylinder 12 is deposited to a thickness of about 500 to 1,000 angstroms. The center rod 16 of cathode 10 is made of a refractory insulation material such as alumina of a thickness of about 0.05 inches in diameter. Next, a refractory metal layer being cylinder 12 is vapor deposited thereon. Next a refractory insulation layer of thickness about 20,000 angstroms being cylinder 14 is deposited on cylinder 12 and this is continued in an alternating manner till a cathode 10 diameter is obtained of about 2 millimeters diameter.

Refractory metals such as niobium may be used for metal cylinders 12. Alumina, for example, can be used for insulating cylinders 14. Alumina and niobium are closely matched in both lattice parameters and thermal expansion coefficients. The aluminum-oxygen bond is so strong that diffusion of oxygen into the niobium will be surpressed.

The niobium layers are from 20–40 times thinner than the insulating alumina which translates into 400–1600 less edge emitter surface area.

This reduced area translates directly into local electric field enhancement by a factor of 400–1600 when compared with a monofilament of conduction material.

The above materials are just an example of a wide variety of compatible materials for this application. Layer thicknesses, spacing an number of layers will be optimized within a selected materials class. One feature of this invention is a cathode 10 that combines these thin conducting layers with lower work functions.

A low work function is necessary and this may be obtained by alloying materials to form a binary or ternary alloy. Such a binary alloy is $LaB_6$. Insulating materials in cylinder 14 may be of refractory oxides, borides, nitrides and carbides.

The emitting end of cathode 10 may have any desired shape. The input end may be connected by conventional metallization process to a metal base for connection into the electrical circuit.

As to the application in an ion microprobe, the cathode 10 is used for investigating atomic arrangements and chemical bonding in conducting materials. The cathode is the material under examination and the anode is a hemispherical fluorescent screen at a distance of about one meter. A voltage of several thousand volts is applied between the anode and the material under study. If the cathode is formed into a sharp needle, the electric field strength, E, at the tip of the needle is enhanced according to the following:

$$E=(k)V/r$$

where V is the applied voltage and r is the tip radius, k is a constant that depends upon the geometry of the tube and other parameters.

It is clear from this equation that maintaining a very sharp tip allows the local electric field intensity to remain high. $2\text{–}5\times10^7$ volts /cm is required for spontaneous emission of electrons from the cathode tip. These field intensities can be achieved with just a few thousand volts if the tip radius is kept under 1,000 angstroms. The electrons are emitted from the surface in directions controlled by the surface arrangement of atoms. Therefore, the pattern displayed on the fluorescent screen anode relates directly to the surface chemistry and magnifications of over 1 million are achieved.

Clearly, many modifications and variations of the present invention are possible in light of the above teachings and it is therefore understood, that within the inventive scope of the inventive concept, the invention may be practiced otherwise than specifically claimed.

What is claimed is:

1. A high emissivity cold cathode, said high emissivity cold cathode comprising:

a central rod, said central rod being made of a refractory and insulating material;

a metal cylindrical tube, said tube being deposited by vapor deposition onto said central rod, said tube being made of a refractory metal, said tube having a wall thickness of less than or about 1,000 angstroms wherein the exposed top edge radius (r) is of a dimension to obtain an electric field strength of about 2 to $5\times10^7$ volts per centimeter for spontaneous electron emission therefrom, said field strength (E) given by $$E=kV/r$$

where V is the applied voltage and k is a constant;

an insulator cylindrical tube, said insulator cylindrical tube being vapor deposited on said metal cylindrical tube, said insulator cylindrical tube being made of a refractory material, said insulation cylindrical tube having a thickness of about 20 times that of said metal cylindrical tube, and additional tubes being deposited thereon in an alternating manner until a determined diameter of said cold cathode is obtained.

2. A high emissivity cold cathode as defined in claim 1 wherein said central rod has a diameter of about 0.050 inch.

3. A high emissivity cold cathode as defined in claim 1 wherein said insulating material is selected from the group comprising oxides, borides, nitrides and carbides.

4. A high emissivity cold cathode as defined in claim 1 wherein said metal cylindrical tube has a thickness from 500 to about 1,000 angstroms.

5. A high emissivity cold cathode as defined in claim 1 wherein said insulating cylindrical tube has a thickness of about 20,000 angstroms.

6. A high emissivity cold cathode as defined in claim 1 wherein said metal is niobium and said insulating material is alumina.

7. A high emissivity cold cathode as defined in claim 1 wherein said refractory metal is an alloy having a low work function and said refractory material of said insulator cylindrical tube is an insulating material of high dielectric breakdown strength.

8. A high emissivity cold cathode as defined in claim 7 wherein said alloy is lanthanum hexaboride, $LaB_6$, and said insulating material is boron nitride, BN.

* * * * *